US005903244A

United States Patent [19]

Dewhurst

[11] Patent Number: 5,903,244

[45] Date of Patent: May 11, 1999

[54] LIGHT DISPLAY AND METHOD OF FORMING THE SAME

[75] Inventor: Richard M. Dewhurst, London, United Kingdom

[73] Assignee: Dewhurst, Hounslow, United Kingdom

[21] Appl. No.: 08/724,796

[22] Filed: Oct. 2, 1996

[30] Foreign Application Priority Data

Oct. 2, 1995 [GB] United Kingdom ..... 9520073

[51] Int. Cl.[6] ..... G09G 3/14

[52] U.S. Cl. ..... 345/46; 345/34

[58] Field of Search ..... 345/46, 44, 33, 345/34, 30, 204; 340/815.45, 815.54

[56] References Cited

U.S. PATENT DOCUMENTS

| | | | |
|---|---|---|---|
| 3,204,234 | 8/1965 | Nakauchi | 345/44 |
| 3,675,242 | 7/1972 | Hammell | 345/44 |
| 3,837,102 | 9/1974 | Golay | 345/44 |
| 3,911,423 | 10/1975 | Arndt et al. | 345/44 |
| 3,918,053 | 11/1975 | Towne et al. | 345/33 |
| 4,623,882 | 11/1986 | Nixon | 345/33 |
| 5,036,440 | 7/1991 | Takii et al. | 362/95 |

*Primary Examiner*—Chanh Nguyen
*Assistant Examiner*—John Suraci
*Attorney, Agent, or Firm*—Pillsbury Madison & Sutro LLP

[57] ABSTRACT

An alpha-numeric display arrangement, designed to be vandal-proof, has an opaque mould plate mounted on the reverse of a metal front plate. Elongate apertures in the front plate each form one of a plurality of segments of the alpha-numeric display. Elongate apertures in the mould plate are each accurately aligned with a respective one of the apertures in the front plate. Molten transparent material is introduced to a required level in each of the contiguous aperture pairs. A space is left above the solidified material in which a light emitting diode mounted on a lighting board is received. Thus, each of the apertures is provided with a light emitting diode which is in optical communication with the transparent material provided within each of the apertures.

18 Claims, 2 Drawing Sheets

LIGHT DISPLAY AND METHOD OF FORMING THE SAME

BACKGROUND OF THE INVENTION

The present invention relates to a light display arrangement and a method of forming the same.

Display arrangements for providing illuminated displays find wide use in a variety of situations. Particular forms of light display arrangements comprise alpha-numeric light displays which are intended to provide for an illuminated figure such as a numeral or letter, or a combination thereof, so as to relay information to persons located in the vicinity of the display.

Typical examples comprise the light displays associated with a light system and which, for those waiting for a lift to arrive at their particular floor level, can provide for a clear indication of the location of the lift in the building at any particular time.

Whether used as part of a lift system or otherwise, light displays are commonly provided at locations readily accessible by members of the public and often without supervision. This has the potential disadvantage that such light displays can comprise readily accessible targets for those intent on vandalism or other potentially destructive activities.

While attempts have been made to provide for so-called vandal-proof light displays, such known displays are found to exhibit limitations and disadvantages. For example, although the information being conveyed by way of the display can be readily identified when the display is viewed head on, the displayed information appears far from clear when the display is viewed from the side thereof. Such disadvantages are particularly exhibited when the display comprises a segmented alpha-numeric display in which the illumination of each of the segments has to be individually controlled so as to provide for the selective display of a required range of numerals and/or letters.

SUMMARY OF THE INVENTION

The present invention seeks to provide for a light display having advantages over known light displays.

According to one aspect of the present invention, there is provided a method of forming a light display having illuminable indicia means, comprising the steps of providing a front plate having at least two discrete apertures for said indicia means, locating a mould plate formed of opaque material adjacent said front plate and wherein said mould plate has at least two discrete apertures located so as to register with said at least two apertures of said front plate respectively, introducing illuminable material into the contiguous apertures of said front plate and said mould plate and locating at least two discrete light source means on said mould plate for optical communication with the illuminable material in said at least two apertures respectively.

The method is advantageous in providing for a light display which can have a suitably strong and secure front plate whilst providing for illuminable material which can extend within the apertures of the front plate, and up to the front surface thereof, and which are in optical communication with the light source means. In this manner, the information to be displayed by way of illumination of the light source means is readily visible from positions which are inclined to the front plate of the display.

Preferably, the front plate is formed of metal and, in particular, the front plate can be formed from stainless steel.

The strength and robust construction of the light display is not only then enhanced, but the appearance of the light display in such that it serves as a deterrent from any would-be vandal in view of the relatively indestructible appearance it affords.

Preferably, said at least two apertures comprise elongate apertures and, in particular, individual segments of a segmented numerical or alpha-numerical display. Thus, although the security of the light display has been enhanced, any required pattern of segments can advantageously be provided so as to achieve the wide range of alpha-numeric characters required.

It is a further feature of the present invention that the mould plate can be mounted on the front plate by way of secure mounting means so as to enhance the strength of the light display arrangement.

Preferably, the front plate and mould plate are introduced into a mould cavity prior to the introduction of molten illuminable material into the apertures thereof. In this manner, the floor of the mould cavity can advantageously serve so as to close off the lower region of each of the said apertures so that the depth to which the molten material is introduced into the apertures can be readily controlled.

The depth to which the molten illuminable material is introduced into the apertures may advantageously be controlled so as to provide for a space in each aperture above the upper level of the molten material, which space can be arranged to receive said light source means. Thus, said light source means can advantageously be mounted directly onto the mould plate and with the light source means received in the upper regions of the apertures.

Preferably, said light source means comprise LED means and, in particular, said light source means can comprise a light panel means having a pattern of light emitting devices which pattern corresponds to the patent of said apertures.

In one particular embodiment, said molten material is arranged to be at least transparent in part.

It will therefore be appreciated that the method of the present invention provides for a light display arrangement in which a mould plate is effectively sandwiched between a front plate and a light panel of the display arrangement. The mould plate not only serves to assist in the delivery of the molten material into the apertures of the front plate but, since it is opaque, also serves to prevent any optical "cross-talk" between adjacent light source means and/or adjacent apertures and illuminable material portions.

According to another aspect of the present invention there is provided an arrangement for forming a light display having illuminable indicia means and comprising a front plate having at least two discrete apertures for said indicia means and a mould plate formed of opaque material and mounted on said front plate such that at least two discrete apertures provided in said mould plate are disposed so as to register with said at least two apertures of said front plate respectively.

According to a further aspect of the present invention, there is provided a light display comprising an arrangement as defined above and having illuminable material located in the contiguous apertures of the front plate and the mould plate and wherein at least two discrete light source means are mounted on said mould plates for optical communication with the illuminable material in said of least two apertures respectively.

It will be course be appreciated that the front plate, mould plate, illuminable means and the light source means can comprise any combination of features as discussed above in relation to the method of the present invention.

It will of course be appreciated that the light display of the present invention can comprise a light display for use with a lift system.

BRIEF DESCRIPTION OF THE DRAWINGS

The invention is described further hereinafter, by way of example only, with reference to the accompanying drawings in which.

DESCRIPTION OF PREFERRED EMBODIMENTS

Figure 1:
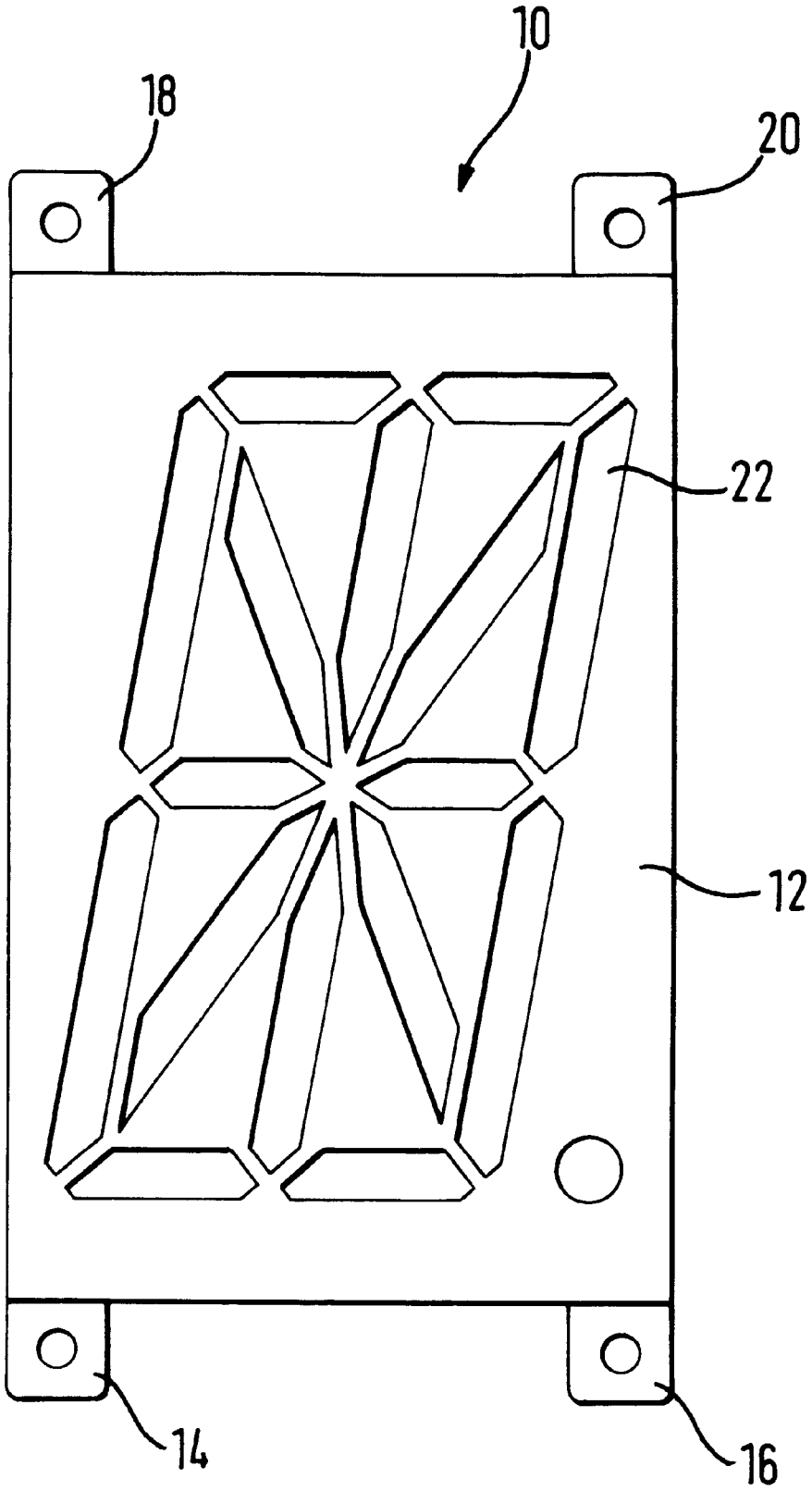
FIG. 1 is a plan view of a light display according to one embodiment of the present invention.

In FIG. 1, there is shown a plan view of a front plate member 10 of an alpha-numeric display arrangement which is designed so as to limit the likelihood of the display suffering damage due to vandalism or otherwise.

As will be described later, the front plate 10 comprises a rectilinear body portion 12 having mounting lugs 14, 16, 18, 20 extending from the four corners thereof so as to provide for engagement with the other components of the display arrangement which are discussed later with reference to FIGS. 2 and 3. The mounting lugs 14, 16, 18 and 20 also allow for the secure mounting of the complete display arrangement within a display casing (not shown).

As will be appreciated, the alpha-numeric display provided by the front plate 10 comprises a plurality of elongate apertures 22 each forming one of a plurality of segments of the alpha-numeric display.

The body portion 12 of the front plate 10 is advantageously formed of steel and, in particular, stainless steel of a thickness in the region of 1.5 mm.

It should be further appreciated that once the assembly of the display arrangement is complete, the front view thereof corresponds to the view of the front plate 10 found in FIG. 1 with, of course, the exception that illuminable material within the aperture segments 22 can be illuminated in any particular manner so as to display the required alpha-numeric character.

Figure 2:
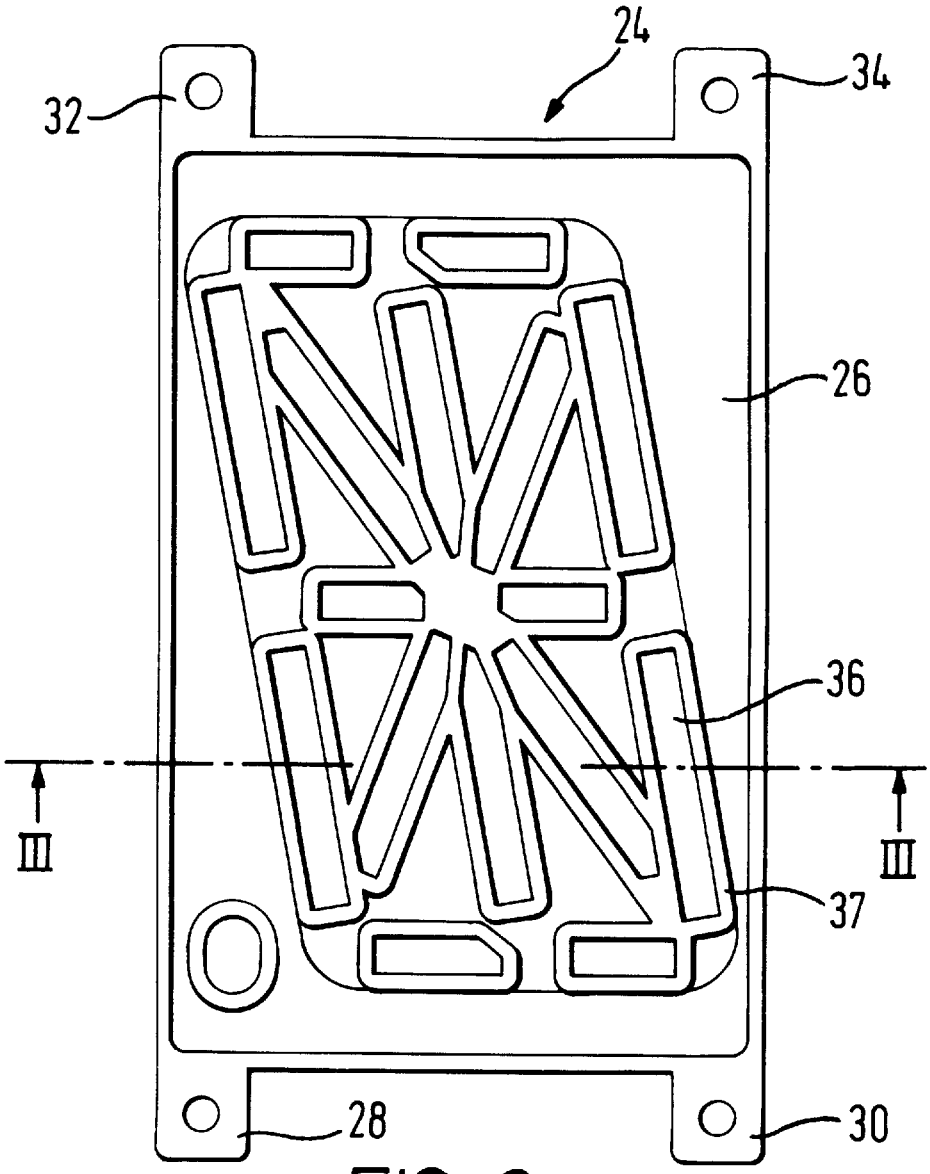
FIG. 2 is a plan view of a mould plate for use in accordance with an embodiment of the present invention.

Turning now to FIG. 2, there is shown a plan view of a mould plate 24 which is mounted on the reverse side of the front plate 10 so as to not only assist in the introduction of illuminable material into the aperture segments of the front plate 10 but also to isolate each of the segments 22 so as to prevent optical "cross-talk" between adjacent. segments and their respective light sources as discussed further below.

The mould plate 24 of FIG. 2 is illustrated as if attached to the rear side of the front plate 10 of FIG. 1 and it can be seen that such secure attachment can be achieved by means of cooperation between the lugs 28, 30, 32, 34 of the mould plate 24 and the respective lugs 14, 16, 18, 20 of the front plate 10.

This rolative location of the mould plate 24 with respect to the front plate 10 serves to accurately align elongate apertures 36 of the mould plate 24 with respective ones of the aperture segments 22 in the front plate 10. Each of the apertures 36 is surrounded by an upstanding flange portion 37 as can be seen clearly from FIG. 3.

Once having had the mould plate 24 mounted on to the reverse side thereof, the front plate 10 can then be located in a mould cavity (not shown) so that, for example, a floor region of the mould cavity serves to close off the front opening of the apertures 22 in the body 12 of the front plate 10.

The plurality of apertures 36 in the mould plate 24 are then contiguous with respective ones of the plurality of apertures 22 in the front plate 10 and molten material, which is to eventually form illuminable segments, is introduced into each of the contiguous aperture pairs (22, 36). A single molten material delivery means can be provided so as to deliver the molten material to each of the contiguous apertures in turn or, alternatively, a plurality of delivery means can be provided so as to deliver molten material to at least two of the apertures simultaneously.

Once the molten material has been introduced to the required level to each of the contiguous aperture pairs (22, 36) in the front plate 10 and the mould plates 24, the material can be allowed to solidify and the combined front plate/mould plate arrangement removed from the mould cavity.

The molten material advantageously introduced into each of the contiguous aperture pairs (22, 36) to a level below the upper extremity of each of the flange portions 37 so that a space remains above the solidified material for receiving light emitting diode means mounted on a lighting board.

Figure 3:
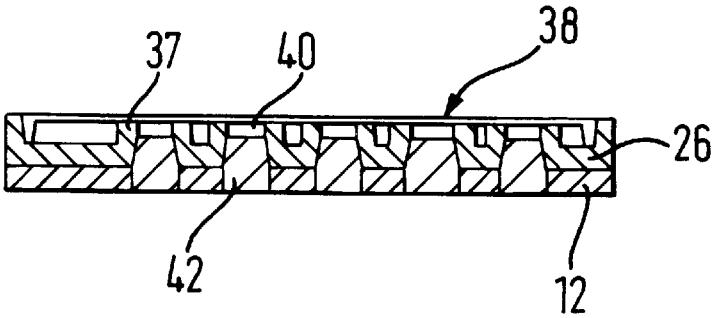
FIG. 3 is a cross-sectional view of a light display embodying the present invention and shown as if taken along the line III—III of the FIG. 2.

Such a lighting board 38, as shown in FIG. 3, can then be mounted on to the back of the mould plate 24 so that discrete light emitting diode devices extend into each of the apertures 36 in the mould plate 24 and to a location closely adjacent the upper surface of the illuminable material.

The final arrangement of the display is illustrated by means of the cross-sectional view of FIG. 3 which represents a cross-section of the display as if taken along a line corresponding to the line III—III of FIG. 2.

As will be appreciated, the body 12 of the front plate 10 combines with the body 26 of the mould plate 24 so as to define the apertures in which the illuminable material 42 is located. The illuminable material 42 is advantageously substantially transparent and extends within each of the apertures up to a level at which it approaches the light source of a light panel 38. The light panel 38 in the illustrated embodiment carries a plurality of light emitting diode means which are arranged in a pattern corresponding to the pattern of the aperture segments 32, 36 of the front plate 10 and mould plate 24 respectively. Thus, as will be appreciated by reference to FIG. 3, each of the apertures is served by a light emitting diode device 40 which is in optical communication with the transparent material 42 provided within each of the apertures.

Since both the body 12 of the front plate 10 and the body 26 of the mould plate 24 are formed of opaque material, the light delivered by each of the light emitting diode devices 40 can only exit from the light display via the substantially transparent material segments 42. Thus, each segment 42 is shielded from its adjacent segments, and their respective light emitting diode devices, via the body portion 26 and flange portions 37 of the moult plate 24.

Further, since the segments 42 have a front surface which is aligned with the front surface of the body 12 of the front plate 10, the illumination of each of the segments is readily visible when the display arrangement is viewed not only from a head on position but also from the side or from above or below.

These advantageous operational features can be achieved by virtue of the present invention in a manner which does not in any way compromise the security, mechanical strength or relative indestructibility of the light display.

It should be appreciated that the invention is not restricted to the details of the foregoing embodiment. For example, any particular aperture pattern can be provided in the front plate and the mould plate dependent generally upon the nature of the display to be provided. Also, any appropriate means can be provided for achieving the secure engagement between the mould plate 24 and the front plate 10 and also between the light board 38 and the mould plate 24. Further, any appropriate form of light source means can be provided in accordance with any particular display pattern required.

I claim:

1. A method of forming a vandal resistant light display having illuminable indicia means, comprising the steps of:

providing a front plate, the front plate having a front surface and a rear surface, and at least two discrete apertures extending through the front plate from the front surface to the rear surface thereof, said apertures defining said indicia means in the front surface of the front plate, providing a mould plate, the mould plate being formed of opaque material and having a front surface and a rear surface, and the mould plate having at least two discrete apertures extending therethrough from the front surface to the rear surface thereof, the peripheral size and shape of each aperture in said mould plate being substantially the same as the peripheral size and shape of a corresponding one of the apertures in said front plate, and locating the mould plate adjacent to said front plate such that the front surface of the mould plate is contiguous with the rear surface of the front plate, and such that each of the apertures of said mould plate is in registry with said corresponding one of the apertures in the front plate whereby each aperture in the front plate together with the corresponding aperture in the rear plate, with which it is in registration, defines a respective bore extending from the front surface of the front plate to the rear surface of the mould plate, introducing illuminable material into said bores to connect the front and mould plates together, the illuminable material filling the apertures in the front surface of the front plate and thereby defining a front surface of the display, and locating at least two discrete light source means on said mould plate for optical communication with the illuminable material in respective ones of said bores.

2. A method according to claim 1, wherein the front plate is formed of metal.

3. A method according to claim 1, wherein said discrete apertures comprise individual segments of a segmented numerical or alpha-numerical display.

4. A method according to claim 1, wherein the mould plate is mounted on the front plate by way of secure mounting means so as to enhance the strength of the light display.

5. A method according to claim 1, wherein said molten material is arranged to be at least transparent in part.

6. A method according to claim 1, wherein the illuminable material is introduced into said bores to leave a space in each bore at the end thereof opening in the rear surface of the mould plate, the method further comprising the step of mounting each light source means in the space in the respective bore.

7. A method according to claim 6, wherein said light source means comprise LED means.

8. A method according to claim 6, wherein said light source means comprises a light panel having a front surface and a plurality of light emitting devices arranged on said front surface, the method further comprising the step of affixing said light panel to said mould plate such that the front surface of said light panel is contiguous with the rear surface of said mould plate and such that each light emitting device is received within said space in a respective bore.

9. A vandal resistant light display having illuminable indicia means, said light display comprising:

a front plate, the front plate having a front surface and a rear surface, and at least two discrete apertures extending through the front plate from the front surface to the rear surface thereof, said apertures defining said indicia means in the front surface of the front plate, a mould plate, the mould plate being formed of opaque material and having a front surface and a rear surface, and the mould plate having at least two discrete apertures extending therethrough from the front surface to the rear surface thereof, the peripheral size and shape of each aperture in said mould plate being substantially the same as the peripheral size and shape of a corresponding one of the apertures in said front plate, said mould plate being connected to said front plate such that the front surface of the mould plate is contiguous with the rear surface of the front plate, and such that each of the apertures of said mould plate is in registry with said corresponding one of the apertures in the front plate whereby each aperture in the front plate together with the corresponding aperture in the rear plate, with which it is in registration, defines a respective bore extending from the front surface of the front surface of the front plate to the rear surface of the mould plate, and said light display further comprising illuminable material extending within said bores and filling the apertures in the front surface of the front plate to thereby define a front surface of the display, and at least two discrete light source means mounted on said mould plate and being in optical communication with the illuminable material in respective ones of said bores.

10. A light display according to claim 9, wherein said front plate is formed of metal.

11. A light display according to claim 10, wherein the front plate is formed from stainless steel.

12. A light display according to claim 9, wherein said at least two apertures in said front plate comprise individual segments of a segmented numerical or alpha-numerical display.

13. A vandal resistant light display according to claim 9, wherein the illuminable material extends in each bore to leave space in each bore at the end thereof opening in the rear surface of the mould plate, and wherein each said light source means is received in the space in the respective bore.

14. A vandal resistant light display according to claim 13, further comprising a light panel having a front surface and a plurality of light emitting devices arranged on said front surface, wherein said light panel is affixed to said mould plate such that the front surface of said light panel is contiguous with the rear surface of said mould plate and such that each light emitting device is received within said space in a respective bore.

15. A method of forming a vandal resistant light display having illuminable indicia means, comprising the steps of:

providing a front plate, the front plate having a front surface and rear surface, and at least two discrete apertures extending through the front plate from the front surface to the rear surface thereof, said apertures defining said indicia means in the front surface of the front plate, providing a mould plate, the mould plate being formed of opaque material and having a front surface and a rear surface, and the mould plate having at least two discrete apertures extending therethrough from the front surface to the rear surface thereof, the peripheral size and shape of each aperture in said mould plate being substantially the same as the peripheral size and shape of a corresponding one of the apertures in said front plate, locating the mould plate adjacent to said front plate such that the front surface of the mould plate is contiguous with the rear surface of the front plate, and such that each of the apertures of said mould plate is in registry with said corresponding one of the apertures in the front plate whereby each aperture in the front plate together with the corresponding aperture in the rear plate, with which it is in registration, defines a respective bore extending from the front surface of the front plate to the rear surface of the mould plate, introducing the front plate and the mould plate, with their apertures in registry, into a mould cavity, introducing molten illuminable material into said bores to connect the front and mould plates together, the illuminable material filling the apertures in the front surface of the front plate and thereby defining a front surface of the display, and controlling the depth to which the molten illuminable material is introduced into the bores to leave a space in each bore at the end thereof opening in the rear surface of the mould plate, and mounting a respective light source in the space in each bore.

16. A method according to claim 15, wherein each said light source comprises LED means.

17. A method according to claim 15, wherein said step of mounting a respective light source comprises providing a light panel having a front surface and a plurality of light emitting devices arranged on said front surface, and affixing said light panel to said mould plate such that the front surface of said light panel is contiguous with the rear surface of said mould plate and such that each light emitting device is received within said space in a respective bore.

18. A method according to claim 15, wherein said step of introducing molten material comprises introducing molten material that is at least transparent in part.

* * * * *